US009592433B2

(12) United States Patent
Alleshouse et al.

(10) Patent No.: US 9,592,433 B2
(45) Date of Patent: Mar. 14, 2017

(54) NOZZLE SHAPES AND CONFIGURATIONS FOR WATER ATTRACTIONS INVOLVING A FLOWING BODY OF WATER

(71) Applicant: Pacific Surf Designs, Inc., San Diego, CA (US)

(72) Inventors: Richard Alleshouse, San Diego, CA (US); Yong L Yeh, Foster City, CA (US)

(73) Assignee: Pacific Surf Designs, Inc., San Diego, CA (US)

( * ) Notice: Subject to any disclaimer, the term of this patent is extended or adjusted under 35 U.S.C. 154(b) by 382 days.

(21) Appl. No.: 14/062,857

(22) Filed: Oct. 24, 2013

(65) Prior Publication Data

US 2015/0209807 A1 Jul. 30, 2015

Related U.S. Application Data

(60) Provisional application No. 61/717,751, filed on Oct. 24, 2012.

(51) Int. Cl.

| | |
|---|---|
| ***B05B 1/04*** | (2006.01) |
| ***A63B 69/00*** | (2006.01) |
| ***A63G 21/18*** | (2006.01) |
| ***B05B 1/02*** | (2006.01) |
| ***B05B 1/00*** | (2006.01) |
| ***A63G 31/00*** | (2006.01) |

(Continued)

(52) U.S. Cl.

CPC ..... *A63B 69/0093* (2013.01); *A63B 69/125* (2013.01); *A63G 21/18* (2013.01); *A63G 31/007* (2013.01); *B05B 1/00* (2013.01); *B05B 1/02* (2013.01); *B05B 1/04* (2013.01); *B05B 1/042* (2013.01); *E04H 4/0006* (2013.01); *B05B 17/085* (2013.01)

(58) Field of Classification Search

CPC .... B05B 1/00; B05B 1/02; B05B 1/04; B05B 1/042; B05B 17/085; A63G 21/18; A63G 31/007; A63B 69/0093; A63B 69/125; E04H 4/0006

USPC ..... 239/592–595, 597, 598, 601; 472/117, 472/128

See application file for complete search history.

(56) References Cited

U.S. PATENT DOCUMENTS 4,688,720 A * 8/1987 MacDonald ..... B05B 17/08 239/597
5,628,584 A * 5/1997 Lochtefeld ..... A63B 69/0093 472/128

(Continued)

*Primary Examiner* — Steven J Ganey
(74) *Attorney, Agent, or Firm* — Aurora Consulting LLC; Ashley Sloat; Kristen Wolff

(57) ABSTRACT

Nozzle orifice shapes and configurations associated with regulating and directing a flowing body of water over a water attraction riding surface for performing board-riding maneuvers is described. The nozzle orifice shapes and configurations according to the present invention includes shapes and configurations allowing for a flow of water over a ride surface which may include complex shapes which do not lend themselves to use with existing nozzle technologies. The present invention also includes nozzle arrays which may be made up of two or more nozzles arranged substantially adjacent or within close proximity to one another to create beneficial flow characteristics for performing board riding maneuvers on a complexly shaped riding surface.

11 Claims, 9 Drawing Sheets

(51) Int. Cl.

| | |
|---|---|
| ***A63B 69/12*** | (2006.01) |
| ***E04H 4/00*** | (2006.01) |
| *B05B 17/08* | (2006.01) |

(56) References Cited

U.S. PATENT DOCUMENTS

| | | | | |
|---|---|---|---|---|
| 6,491,589 | B1 * | 12/2002 | Lochtefeld | A63C 19/00 472/117 |
| 8,251,302 | B2 * | 8/2012 | Sloan, Jr. | B05B 1/00 239/592 |
| 8,893,644 | B2 * | 11/2014 | Nakamura | B05B 1/044 239/592 |

* cited by examiner

NOZZLE SHAPES AND CONFIGURATIONS FOR WATER ATTRACTIONS INVOLVING A FLOWING BODY OF WATER

CROSS-REFERENCE TO RELATED APPLICATIONS

This application is related to U.S. Continuation patent application Ser. No. 14/052,726 entitled, "Water Attractions Involving a Flowing Body of Water" and filed Oct. 12, 2013, the entirety of which incorporated herein by this reference.

This application claims the benefit of U.S. Provisional Application. No. 61/717,751, filed Oct. 24, 2012, the entirety of which is incorporated herein by this reference.

INCORPORATION BY REFERENCE

All publications and patent applications mentioned in this specification are herein incorporated by reference to the same extent as if each individual publication or patent application was specifically and individually indicated to be incorporated by reference.

FIELD OF INVENTION

This invention relates to the field of water attractions, and more specifically, to the nozzle orifice shapes and configurations associated with regulating and directing a flowing body of water over a surface (collectively, a "nozzle") having sufficient area, depth, and speed allowing riders to perform surfboard, skimboard, snowboard, skateboard, bodyboard, bodysurf, inner-tube style maneuvers or other water riding maneuvers (collectively, "boardriding maneuvers").

BACKGROUND OF THE INVENTION

Conventional water attractions that allow for boardriding maneuvers, typically involve a flowing body of water. In these attractions, the flowing body of water in which such flowing body of water is of such depth that the surface boundary layer effects of the flowing body of water over a limited number of wave forming surfaces significantly influence the rider's ability to perform boardriding maneuvers. Such "sheet wave" water attractions may simulate a stationary unbreaking ocean wave or, through the use naturally-occurring ocean wave shape, may create a stationary barreling wave, or a combination of the two.

In existing inventions, a flowing body of water is created by a nozzle or a series of nozzles having either a planar or radial orifice, projecting water onto a surface which is unchanging with respect to any vertical plane taken through the attraction parallel to the flow at any given point, or involves projecting a flow of water which is parallel across the width of the flowing body of water onto a geometrically changing surface. In both cases the surface shape is substantially unchanging with respect to time.

Such existing "sheet wave" water attractions with such nozzle shapes and configurations are limited to creating certain planar "sheet flows." Thus, there is a need in the field of nozzle shapes and configurations for water attractions that will allow for non-planar flows of water emanating from a nozzle or a series of nozzles which may have nozzle orifices with varying widths, thicknesses, and/or acceleration characteristics, varying in flow direction in configurations more complex than planar and radial, and flows which emanate from a nozzle or a series of nozzles which are specifically designed to flare or spread the flow with respect to distance from the nozzle orifice or orifices in order to achieve specific flow characteristics or features on flow supporting surfaces, and modular nozzles which can be combined in an array to form a flowing body of water over a complex riding surface. There is also a need in the field for an invention which covers the use of radially-oriented nozzle orifice configurations, which creates a flowing body of water onto a surface which is changing with respect to distance, orientation, height, angle, slope, steepness, and other additional characteristics from the nozzle orifice or orifices of the radially-oriented nozzle or series of nozzles.

SUMMARY OF THE INVENTION

The present invention relates to the use of nozzle shapes and configurations which create a flowing body of water over a surface in a substantially uniform, radial orientation over a substantially changing ride surface. Such ride surface may vary at different planes parallel to the path of the flowing body of water in terms of the substantially horizontal length, slope height, slope steepness, or angle of inclination as well as the angle of orientation to the flow of water. Furthermore, the invention relates to the use of a nozzle or a series of nozzles where the nozzle orifice or orifices may project water from the orifice or orifices which is not substantially radial or planar and may vary in angle, pitch, thickness, direction or other similar characteristics along one or more planes and may even entail varying in more than one plane at one time. The present invention also includes nozzle arrays which may be made up of two or more nozzles where the nozzles are arranged substantially adjacent or within close proximity to one another such that multiple water flows can be directed towards downstream water features in such a way as to create beneficial and controllable flow characteristics. Finally, the present invention covers a nozzle which is designed such that the angle of flow emanating from a planar nozzle may be greater than 10°, measured as the angle between two arrows, the first defined by either edge of the flowing body of water and the second of which is defined by an arrow perpendicular to the nozzle orifice in the direction of flow.

The shape and configuration of the present invention may allow for the ability to adjust the thickness and width of the flowing body of water along various planes, pitches, velocities and other characteristics of the flowing body of water.

The present invention may allow for the ability to configure two or more nozzles in a manner allowing for the emanation of a flowing body of water in non-parallel paths, including, but not limited to, the ability to correspond to irregular ride surfaces.

DETAILED DESCRIPTION OF SOME EMBODIMENTS

The following description of the preferred embodiments of the invention is not intended to limit the invention to this preferred embodiment, but rather to enable any person skilled in the art to make and use this invention.

Figure 1:
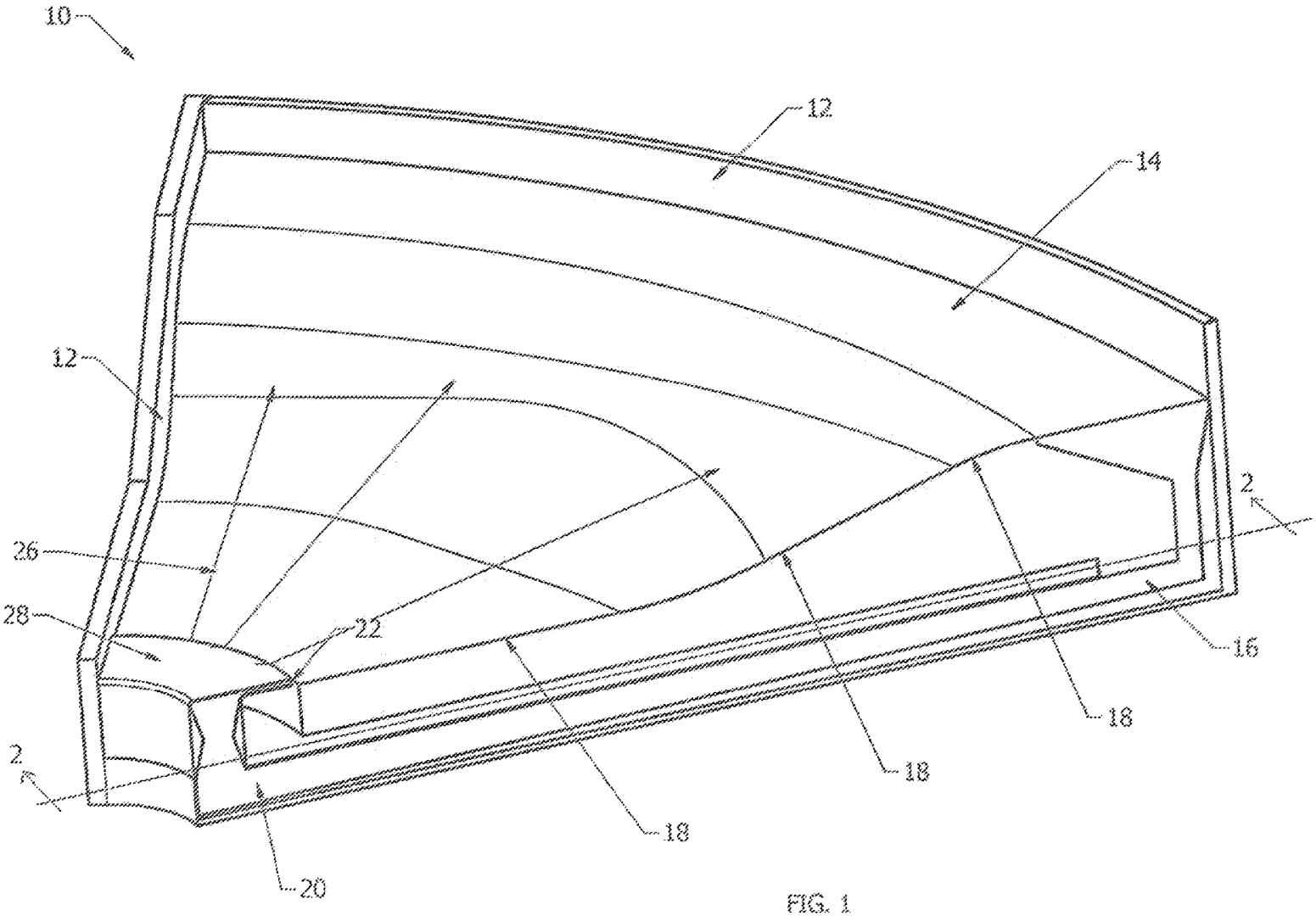
FIG. 1 is an isometric view of one embodiment of the present invention in the first variation depicting the nozzle or series of nozzles, including a flowing body of water and water ride attraction.

Referring now to the invention in more detail, as shown in FIG. 1 there is shown a water ride attraction 10 of the preferred embodiment which may or may not include surrounding walls 12. The water ride attraction is comprised of a water delivery apparatus 28 which delivers a flowing body of water 26 via a nozzle orifice 22 onto a ride surface 18 which may be flat, inclined, curved or complexly curved. The ride surface 18 acts to create a shape for the flowing body of water 26 to conform to the ride surface as it travels towards the water recovery section 14. After entering the water recovery section 14, the water travels through the water return channel 16 to the water energizing chamber 20, which may contain a pump or other water accelerating device, and back to the water delivery apparatus 28.

In more detail, still referring to the invention of FIG. 1, the orifice 22 of the water delivery apparatus 28 may be non-planar and may or may not conform to a specific radius. Furthermore, the sloped section of the ride surface 18 may vary in steepness, angle, slope, radius of curvature, or profile depending on the location along the ride surface 18 while still allowing a rider skilled in the art to perform boardriding maneuvers on the flowing body of water 26.

Figure 2:
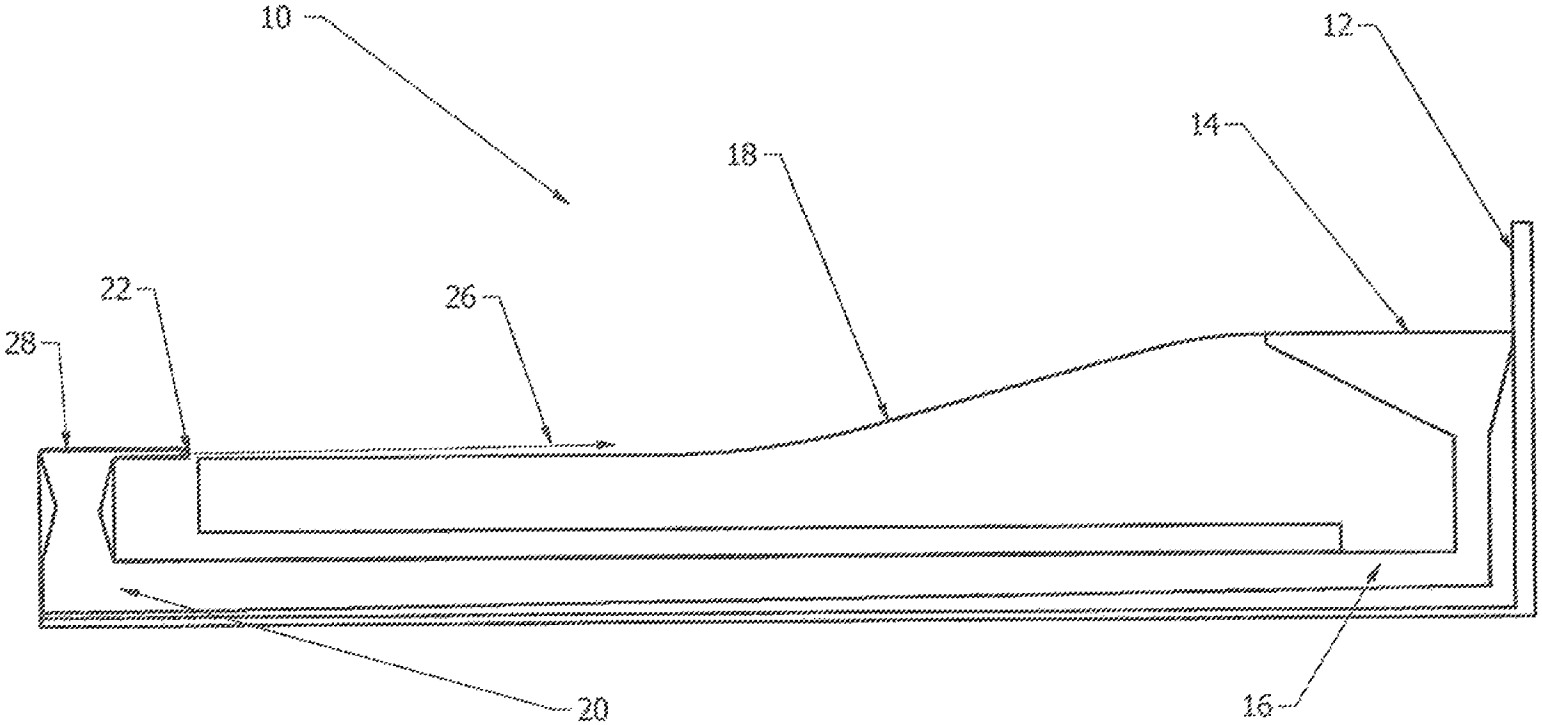
FIG. 2 is a longitudinal cross-section of the nozzle shape, including a flowing body of water and water ride attraction, of the present invention of FIG. 1.
Figure 4A:
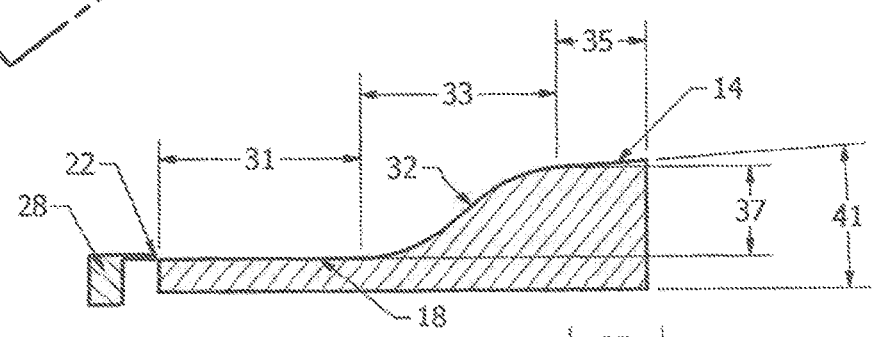
FIGS. 4A through 4C are a set of longitudinal cross-sectional views as depicted in FIG. 3.
Figure 4B:
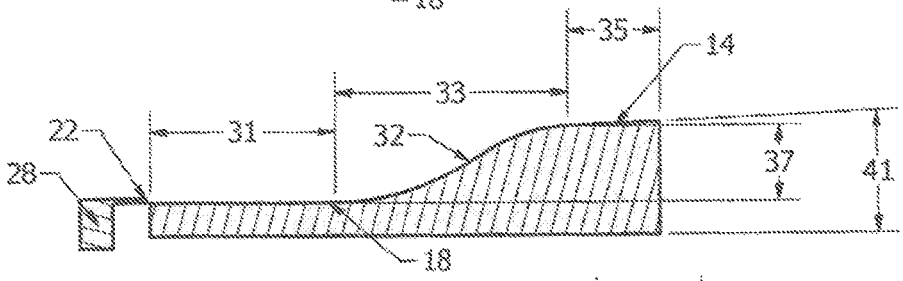
Figure 4C:
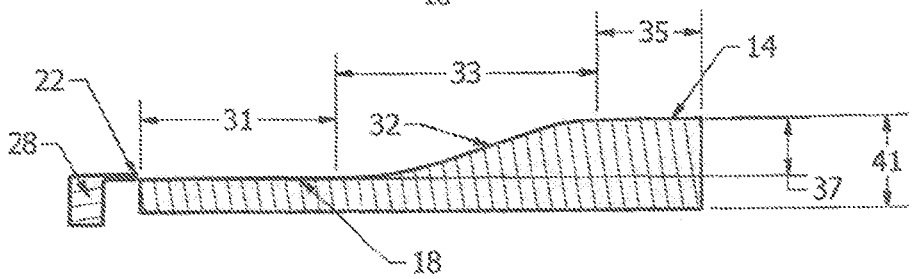

Referring now to FIG. 2, there is a section view of the water ride attraction 10 showing the water delivery apparatus 28 which distributes a flowing body of water 26 over the ride surface 18 via a nozzle orifice 22. The flowing body of water travels over the ride surface and onto the water recovery section 14 where, by the forces of gravity, the water falls to the water return channel 16 where the water is directed towards the water energizing chamber 20 and back to the water delivery apparatus 28. FIGS. 4A through 4C depict the section view shown in FIG. 2 at different points along the ride surface 18, where FIGS. 4A through 4C may vary depending on the design of the water attraction 10, with an initial length 31, a length of the sloped section 33, a slope steepness 32, and a length of the water recovery section 35 of the ride surface 18 where at least one of the above mentioned measurements varies over the ride surface 18. In the current embodiment, the height of the slope 37 remains constant.

Figure 3:
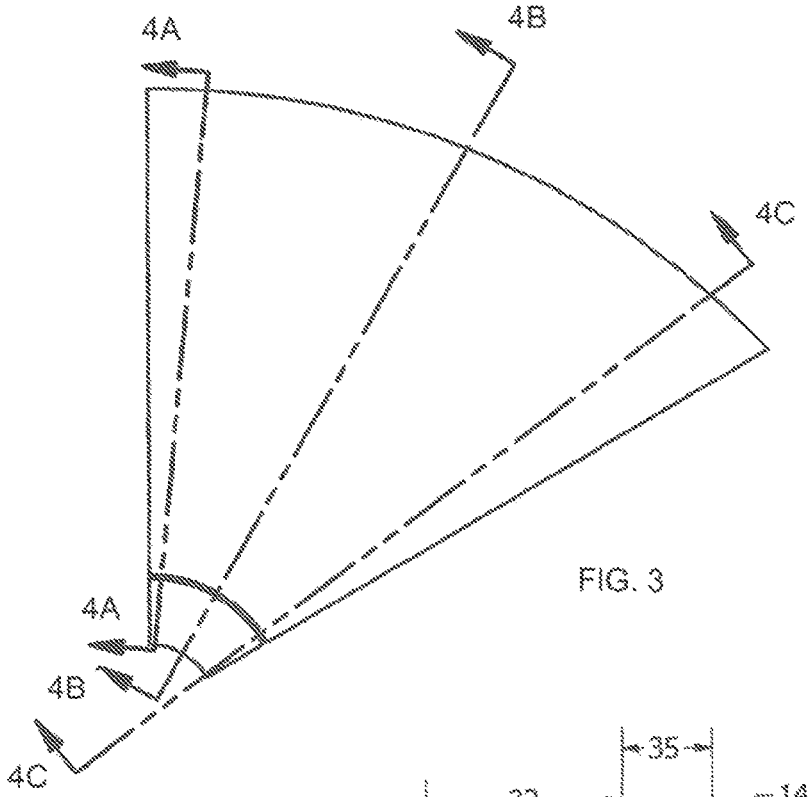
FIG. 3 is a plan view of the present invention, as depicted in FIG. 1.

Now referring to FIG. 3, there is a plan view of the ride surface 18, as shown in FIG. 1, with section views 5-*a*, 5-*b*, and 5-*c*, representing possible sectional views of the invention 10 as shown in FIG. 2. FIGS. 4A through 4C show the present invention 10, with an initial length 31, a length of the sloped section 33, a slope steepness 32, and a length of the water recovery section 35 of the ride surface 18, which measurements may vary over the ride surface 18. In the current embodiment, the height of the slope 37 remains constant although the height may vary. The initial length 31 may vary considerably between 1 and 20 meters and may vary at different sections on the current water ride attraction 10. The length of the sloped section 33 may vary considerably between 0.05 and 20 meters and may vary at different sections on the current water ride attraction 10. The slope steepness can vary considerably between 1° and 150° from the horizontal where a slope steeper than 90° would create an inverted ride section 52 (as shown in FIG. 6) and a crest 50 (as shown in FIG. 6) and may vary at different sections on the current water ride attraction 10.

Figure 5:
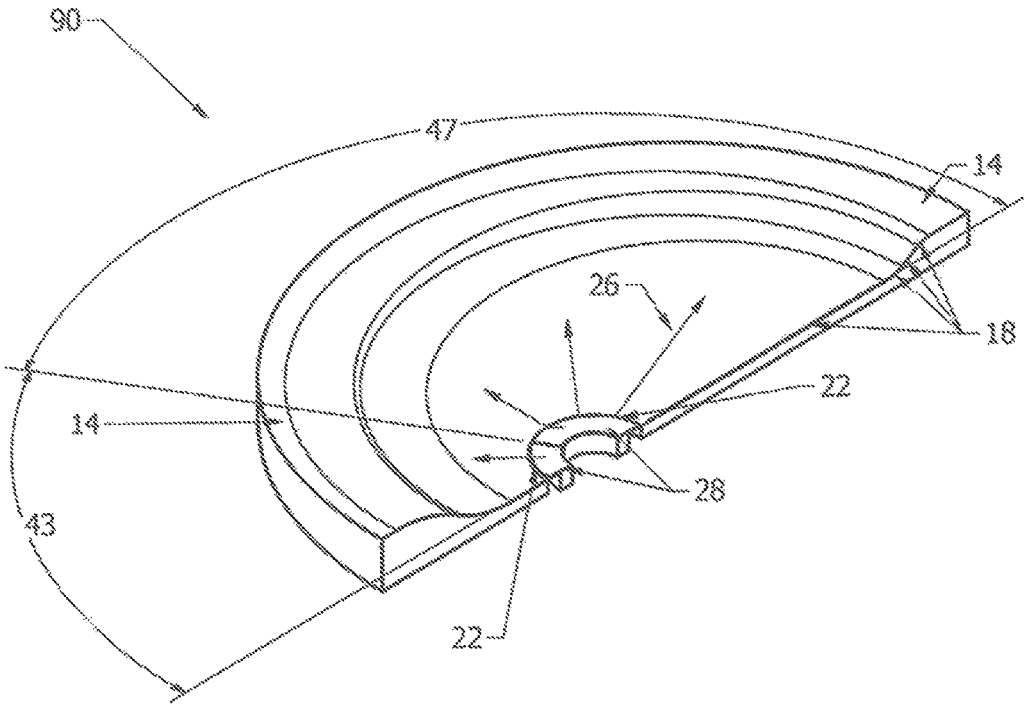
FIG. 5 is an isometric view of another embodiment of the present invention depicting the nozzle or a series of nozzles and water ride attraction.

In another embodiment 90, as shown in FIG. 5, the flowing body of water 26 originates from two or more separates orifices 22 in which the orifice angle 43 of one of the water delivery apparatuses 28 may be greater than, equal to, or less than the angle of the orifice angle 47 for the second water delivery apparatus 28 orifice or additional orifice angles (not shown) if additional orifices are used. The combined orifice angle 43 and 47 may be equal to, greater than, or less than 180° and may be made up of one or more water delivery apparatuses and orifice angles. Another variation of the water delivery apparatus 28 of the embodiment 90 may involve either a combination of one or more water delivery apparatuses and/or one or more nozzle orifices.

Figure 6:
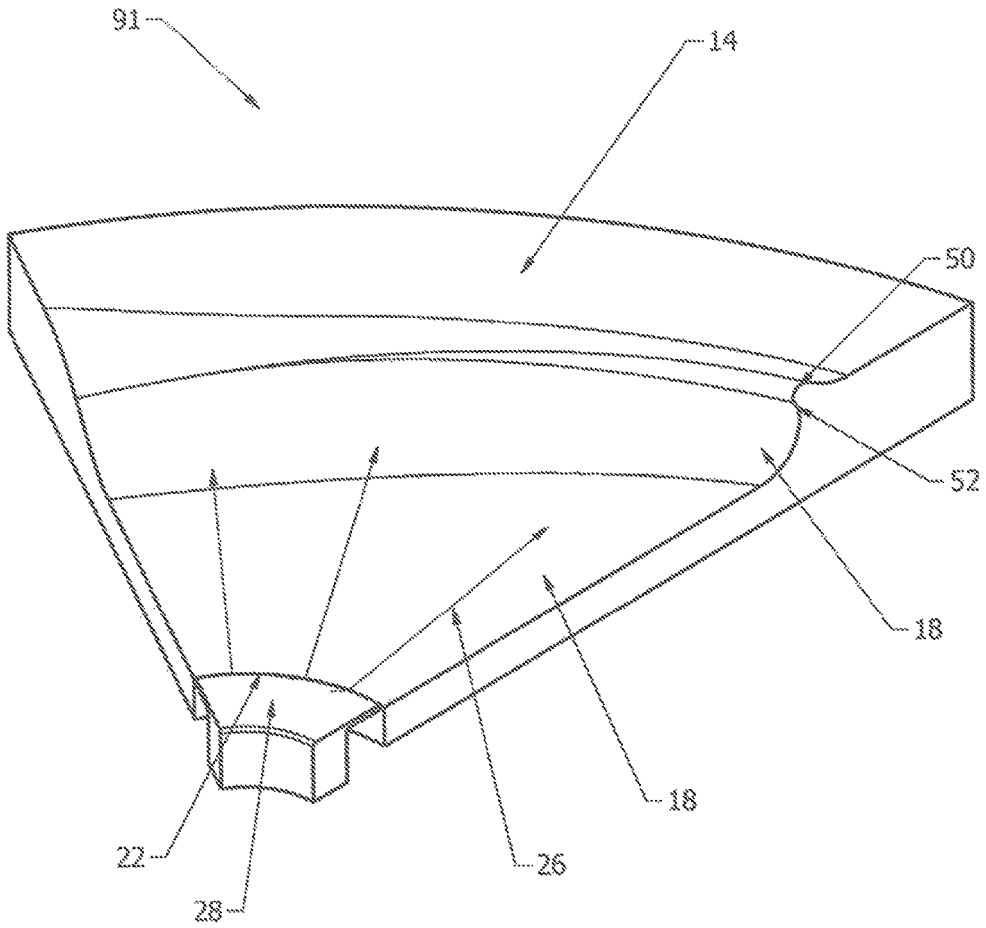
FIG. 6 is an isometric view of another embodiment of the present invention depicting the nozzle and water ride attraction.

In another embodiment 91, as shown in FIG. 6, the flowing body of water 26 originates from the water delivery apparatus 28, which may consist of one or more water delivery apparatuses, towards a ride surface 18 which may include a sloped section with an angle greater than 90° where an inverted ride section 52 and/or a crest 52 is created.

Figure 7:
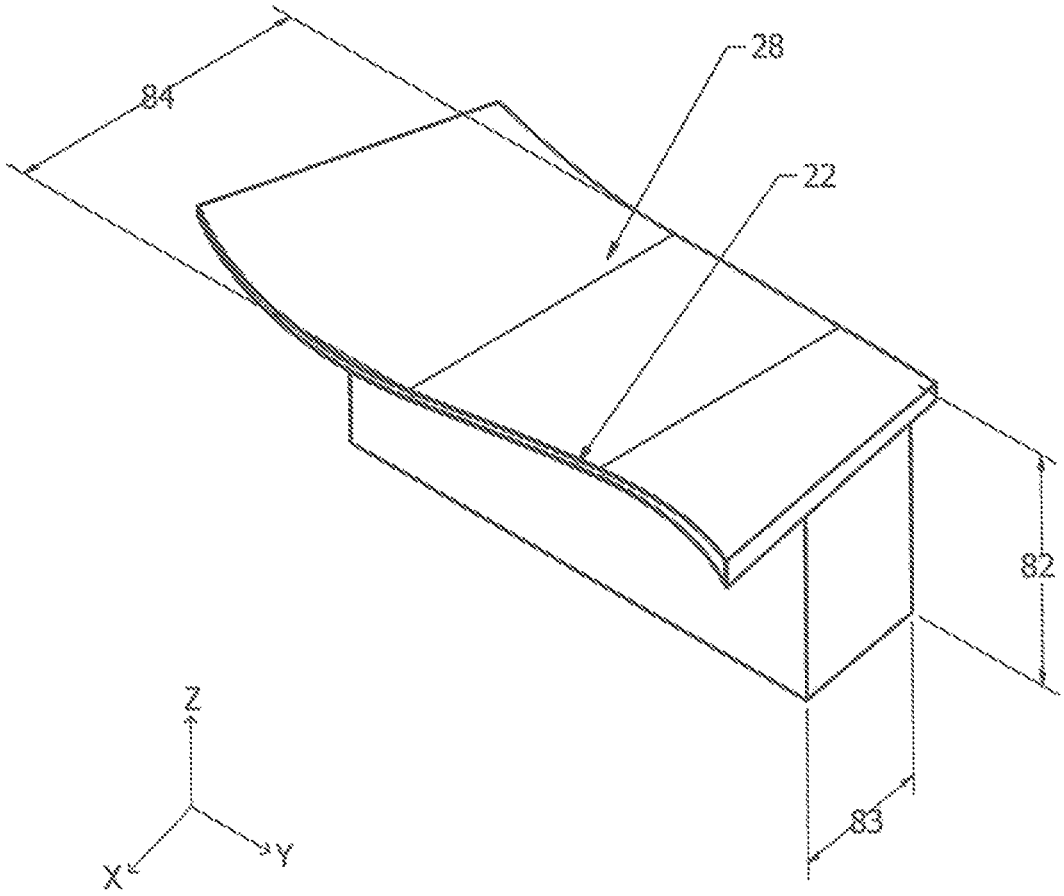
FIG. 7 is an isometric view of one embodiment of the nozzle and water delivery apparatus.
Figure 8:
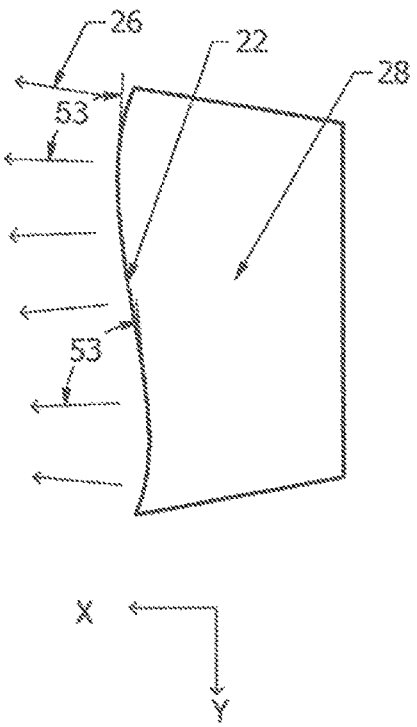
FIG. 8 is a top view of the nozzle of FIG. 7.
Figure 9:
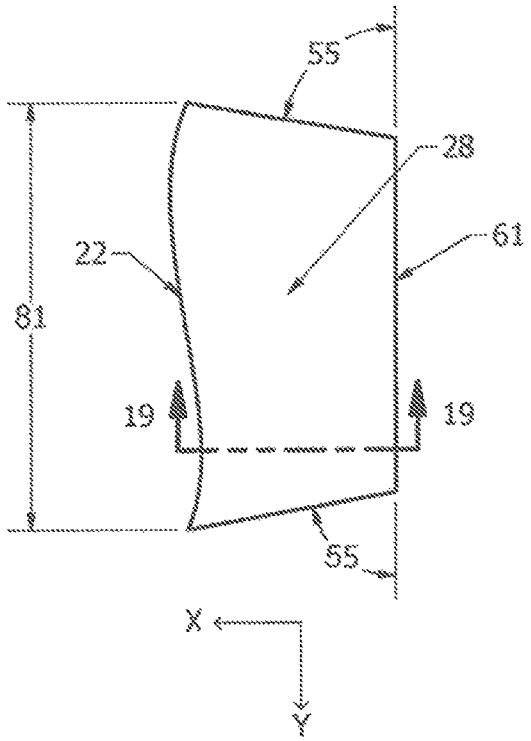
FIG. 9 is a top view of the nozzle of FIG. 7.
Figure 10:
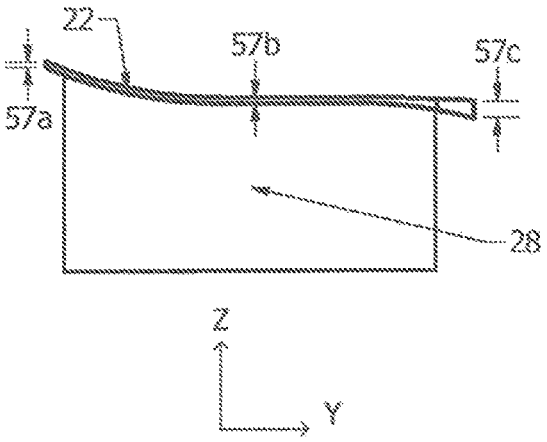
FIG. 10 is a front view of the nozzle of FIG. 7.
Figure 11:
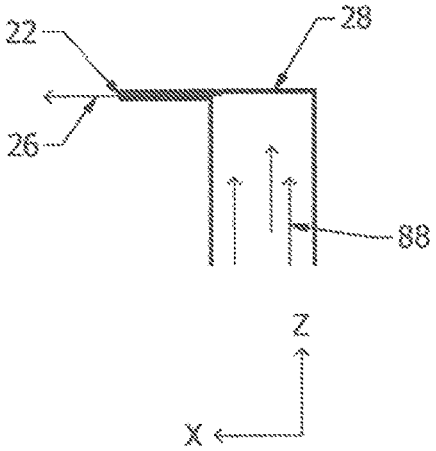
FIG. 11 is a longitudinal cross-sectional view as depicted in FIG. 7.

Now referring to FIGS. 7-11, there are shown variations of the water delivery apparatus 28 and nozzle orifice 22. Referring to the water delivery apparatus and nozzle orifice in more detail, as shown in FIGS. 7-8, there is a non-planar orifice 22 which may have varying flow angles 53 along its length which could create a flowing body of water 26 emanating in different directions from the orifice 22. As shown in FIG. 9, the side angle 55 may also vary considerable from an angle of 10°-165° from the rear plane 61 of the water deliver apparatus 28. As shown in FIG. 10, the orifice opening of orifice 22 may further vary in thickness 57 along its length creating a flowing body of water which may vary in thickness (as shown by 5*a*, 5*b*, and 5*c*), depending on the relative location from the water delivery device 28. As shown in FIG. 11, the orifice 22 may be non-planar in the x-y, y-z or z-y planes, or any combination thereof as shown in FIGS. 8-10.

In another embodiment of the invention not shown in the FIGURES, the water delivery apparatus 28 may have an orifice 22 which is non-planar and varies along the z-y, y-z and z-x planes, or any combination thereof as well as having a varying angle 59 from the vertical where the flowing body of water could flow in an upward or downward orientation from the water delivery apparatus 28 with or without a varying thickness 57.

In order to construct the water delivery apparatus 28, including the nozzle orifice 22, of adequate size to deliver an adequate flow of water, for purposes of scale and not limitation, referring to FIGS. 7 and 11, the dimensions of the water delivery apparatus can be between: (i) 1 and 50 inches or (ii) 1 and 60 inches or (iii) 1 and 70 inches or (iv) 1 and 80 inches in length 81; between (i) 1 and 20 inches or (ii) 1 and 40 inches or (iii) 1 and 80 inches or (iv) 1 and 120 inches in height 82; between 1 and 80 inches in width 83; between (i) 1 and 50 inches or (ii) 1 and 100 inches or (iii) 1 and 150 inches in width 84, including the nozzle orifice 22.

The water-delivery apparatus 28, including the nozzle orifice 22, may be made front ferrous or non-ferrous materials, plastics, concrete, fiber reinforced systems, thermoplastic materials, alloys, including but not limited to stainless steel, steel, painted steel, epoxy, aluminum, copper, reinforced concrete or cement, reinforced thermoplastic materials and fiberglass or FRP.

Figure 12:
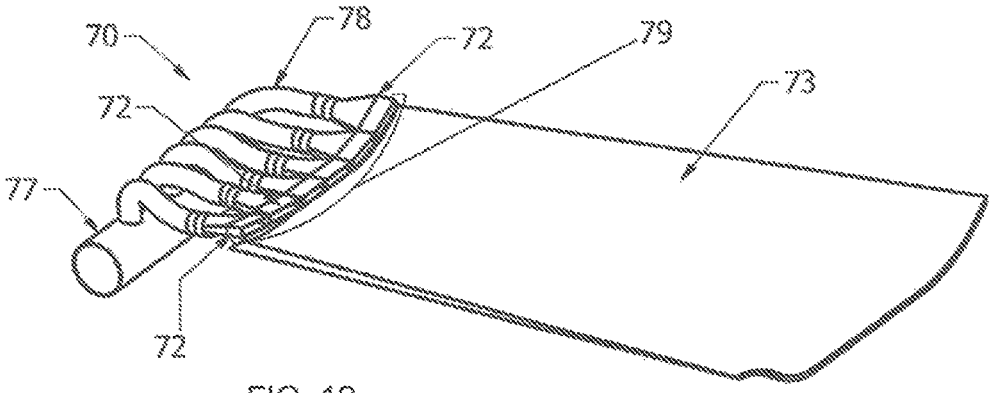
FIG. 12 is an isometric view of another embodiment of the present invention.
Figure 13:
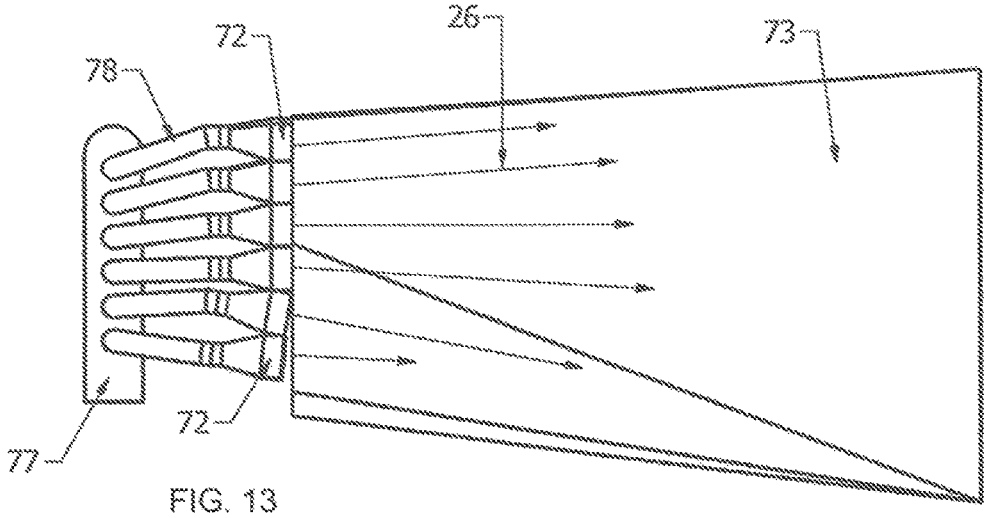
FIG. 13 is a top view of the embodiment of FIG. 12.

Now referring to FIGS. 12-13, in another embodiment of the invention 70, there is shown a nozzle array 79 which is used to project a flowing body of water 26 onto a ride surface 73 on which boardriding maneuvers may be performed. Furthermore, the invention is comprised of a series of modular nozzles 72 arranged in a nozzle array 79, which are placed in an orientation such that they project a flowing body of water 26 on to a ride surface 73, which is shaped in such a way that a rider may perform boardriding maneuvers on a flowing body of water 26. The modular nozzles 72 may be oriented in such a nozzle array 79 such that a nozzle array 79 may project water in substantially the same direction, or the nozzle array 79 may be oriented in a non-planar manner such that the flowing body of water 26 emanates in a series of planes which may or may not be parallel, tangent or collinear. The modular nozzles 72 may all be used together to form one flowing body of water or may be used individually to form two or more flowing bodies of water on a single riding surface or multiple ride surfaces which may or may not be contiguous.

Figure 14:
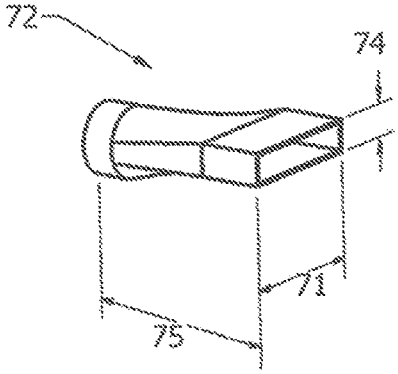
FIG. 14 is an isometric view of the nozzle of FIG. 12.

Now referring to FIG. 14 in more detail, the modular nozzle 72 is made of a width 71 varying from 1 inch to 80 inches, a thickness 74 varying from 1 inch to 16 inches, and a length 75 varying from 1 inch to 80 inches. The individual modular nozzle 72 may have the ability to independently adjust the orifice thickness, and such orifice thickness may be adjusted in a non-uniform manner over the width 71 of the orifice opening. The different modular nozzles 72 arranged in a nozzle array 79 may all be operated at the same flow rate and/or flow pressure or at different flow rates and/or flow pressures. The modular nozzles 72 may be powered by a single water energizing device (not shown), such as a pump, or each modular nozzle may be powered by its own water energizing device.

Figure 15:
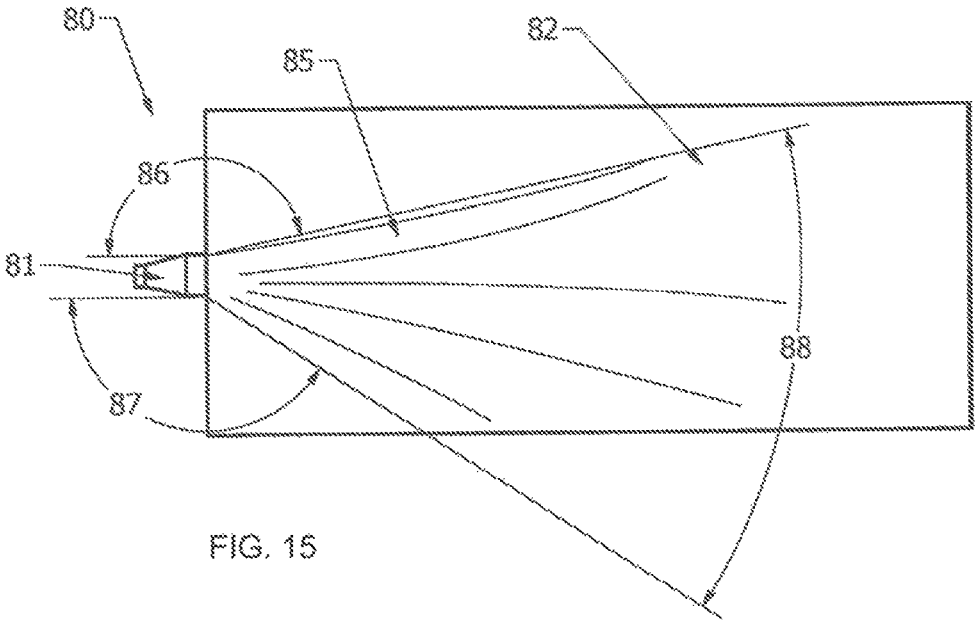
FIG. 15 is a top view of the nozzle of FIG. 12 individually shown on the embodiment shown in FIG. 13.

Now referring to FIG. 15, in another invention 80, there is a water delivery apparatus 81 which projects a flowing body of water 85 onto a ride surface 82 such that riders can perform boardriding maneuvers. The nozzle is configured in such a way that the projection angle 86 and opposing projection angle 87 are less than 170° and may be different or equal to each other such that the water exiting the nozzle is allowed to spread and create a flowing body of water with a net flow angle 88 greater than 10° such that the water emanating from the nozzle may specifically spread over a surface in such a way as to create a favorable flowing body of water to compliment the ride surface allowing for boardriding maneuvers to be performed.

As a person skilled in the art will recognize from the previous detailed description and from the figures and claims, modifications and changes can be made to the preferred embodiments of the invention without departing from the scope of this invention defined in the following claims. Those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A nozzle for creating a flowing body of water over a riding surface, the nozzle comprising:

a plurality of orifice walls forming an orifice, wherein the flowing body of water emanates from the orifice in a non-parallel flow over the riding surface, wherein the orifice is non-planar in a Z-Y plane creating a varying thickness of the orifice in the Z-Y plane, and wherein the thickness of the orifice in the Z-Y plane is adjustable to different thicknesses along a length of the orifice in the Z-Y plane.

2. The nozzle of claim 1, wherein the ride surface comprises sloped sections varying, in one or more of steepness, angle, slope, radius of curvature, and profile.

3. The nozzle of claim 1, wherein the nozzle comprises one or more of metals, alloys, ceramics, plastics, composite materials, and fiberglass.

4. The nozzle of claim 1, wherein the orifice is non-planar in an X-Y plane.

5. The nozzle of claim 4, wherein the orifice is radial in the X-Y plane.

6. The nozzle of claim 1, wherein the flowing body of water emanates from the orifice at a projection angle and an opposing projection angle that are less than 170 degrees and the projection angle and the opposing projection angle are different.

7. The nozzle of claim 1, wherein the flowing body of water emanates from the orifice at flow angles that vary along a length of the orifice formed by the plurality of orifice walls.

8. The nozzle of claim 1, wherein a variation in a sloped section of the riding surface depends on a location of the non-parallel flow.

9. The nozzle of claim 1, wherein at least one of the plurality of orifice walls is non-conforming to a specific radius.

10. The nozzle of claim 1, further comprising a plurality of outer walls outside of the plurality of orifice walls, wherein the plurality of outer walls is at a different angle than the plurality of orifice walls.

11. A nozzle for creating a flowing body of water over a riding surface, the nozzle comprising:

a plurality of orifice walls forming an orifice, wherein the flowing body of water emanates from the orifice in a non-parallel flow over the riding surface; and a plurality of internal walls coupled to sides of the plurality of orifice walls, wherein the plurality of internal walls forms a side angle from a rear plane of the nozzle to the sides of the plurality of orifice walls of the orifice.

* * * * *